United States Patent [19]

Ingalls

[11] Patent Number: 4,607,383

[45] Date of Patent: Aug. 19, 1986

[54] THROAT MICROPHONE

[75] Inventor: Robert Ingalls, Epping, N.H.

[73] Assignee: Gentex Corporation, Carbondale, Pa.

[21] Appl. No.: 524,377

[22] Filed: Aug. 18, 1983

[51] Int. Cl.[4] ..... H04R 1/02; H04R 3/06; H04R 19/00; H04R 19/01

[52] U.S. Cl. ..... 381/88; 179/111 E; 179/111 R; 179/121 C; 179/157; 381/98; 381/113

[58] Field of Search ..... 381/87, 88, 98, 101, 381/113; 179/111 E, 111 R, 121 C, 157, 115 R

[56] References Cited

U.S. PATENT DOCUMENTS

| | | | |
|---|---|---|---|
| 2,340,777 | 2/1944 | Stanley | 179/121 C |
| 2,790,032 | 4/1957 | Palle-Firn Beer | 179/121 C |
| 2,958,740 | 11/1960 | Kirk | 179/121 C |
| 3,148,677 | 9/1964 | Smith | 179/121 C |
| 4,443,666 | 4/1984 | Cote | 179/111 E |

FOREIGN PATENT DOCUMENTS

| | | | |
|---|---|---|---|
| 46-38679 | 11/1971 | Japan | 179/121 C |
| 1053604 | 1/1967 | United Kingdom | 179/121 C |

*Primary Examiner*—Gene Z. Rubinson
*Assistant Examiner*—Danita R. Byrd
*Attorney, Agent, or Firm*—Shenier & O'Connor

[57] ABSTRACT

A throat microphone has an outer resonant diaphragm which is adapted to be secured against the throat of a wearer and which cooperates with a housing to form an outer chamber. An electret microphone element disposed inside the outer chamber includes an electret diaphragm acoustically coupled to the outer diaphragm and an electret housing forming an inner chamber with the electret diaphragm. The electret diaphragm is perforated to provide pressure relief between the two chambers to give the electret microphone element a rising response characteristic, which is enhanced by a differentiating network in the input circuit of a local preamplifier. The outer diaphragm is so formed as to have a principal resonance at about 3 kilohertz to provide a further emphasis to voice frequencies at or near that resonance.

4 Claims, 9 Drawing Figures

Fig 6
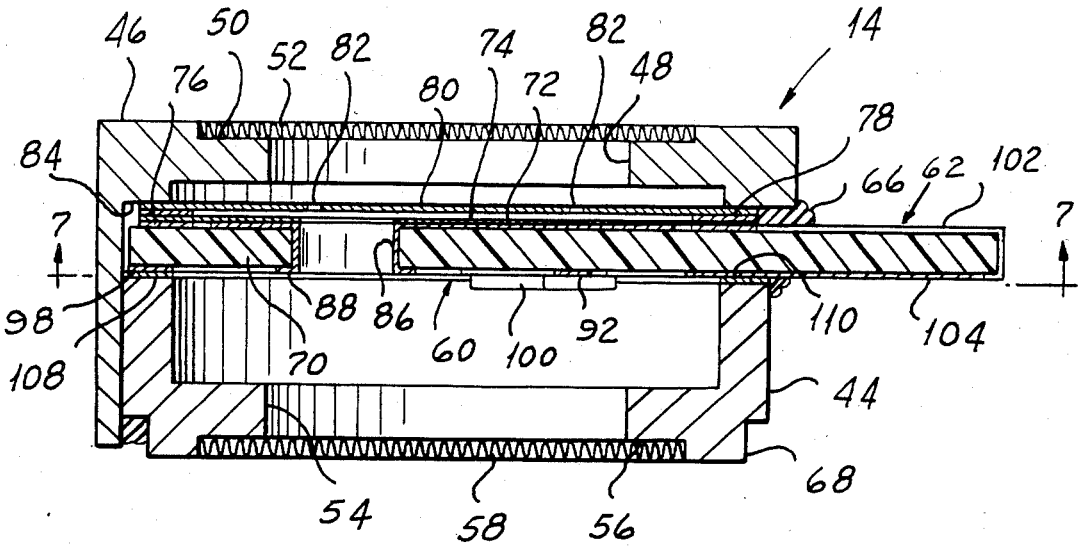
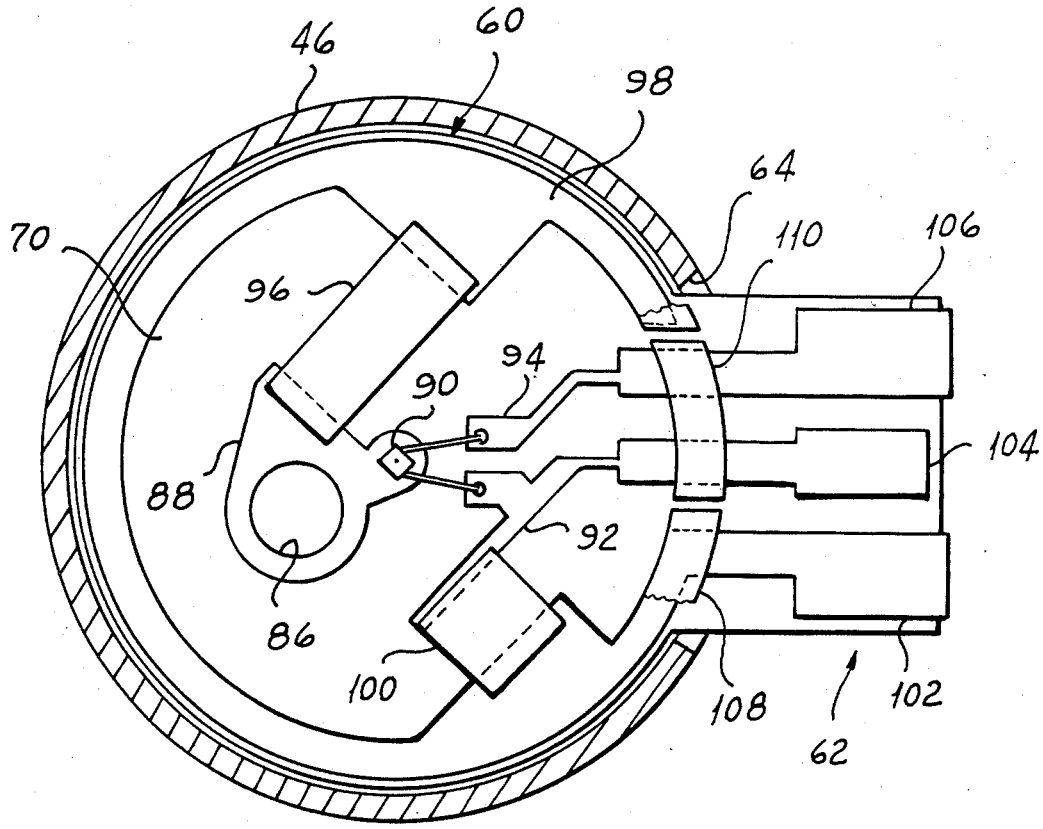
Fig 7

THROAT MICROPHONE

FIELD OF THE INVENTION

This invention relates to a contact microphone intended for voice communication and, in particular, to a throat microphone employing an electret transducer element.

BACKGROUND OF THE INVENTION

Contact microphones adapted to engage the throat or other vibrating body portion adjacent to the larynx of a wearer are well known in the art. Such microphones are particularly advantageous in noisy environments since they rely on direct mechanical coupling to the larynx of the wearer rather than merely acoustic coupling as in the usual arrangement. On the other hand, the nature of the mechanical coupling produces a severe attenuation at high frequencies, particularly those frequencies above about 350 hertz containing most of the intelligible information.

Various attempts have been made in the prior art to improve the high-frequency response of throat microphones. For example Kuhlik U.S. Pat. No. 2,385,867 discloses an arrangement in which a dynamic microphone is placed inside a sound box that is adjacent to the larynx of the wearer. According to the patentee, the sound box acts as a resonance chamber emphasizing voice frequencies. Although the sound box is said to eliminate noise, the construction is such that it responds to all mechanical vibrations, not merely those emanating from the throat.

Other contact microphones, such as those shown in Greibach U.S. Pat. No. 2,255,249, Sears et al U.S. Pat. No. 2,260,727 and Stanley U.S. Pat. No. 2,340,777, use resonating mechanical elements inside the microphone housing to provide the desired emphasis in the voice range. In one embodiment shown in the Sears et al patent, the mechanical resonator also includes a button adapted to engage the flesh of the wearer. In each of the devices disclosed, the mechanical resonators are directly coupled mechanically to the resistive or electromagnetic transducer element of the microphone. Such resonators would be relatively unsuitable for use in conjunction with electret microphone elements, the diaphragms of which are very light and cannot be loaded mechanically without drastically altering their performance.

Still others have sought to obtain a desired rising response characteristic from a throat microphone purely by electrical means. Thus, Ballantine U.S. Pat. No. 2,121,778 discloses various filtering networks including one in which a grid leak resistor forms a differentiator with a piezoelectric microphone crystal. Although electrical filters of the type disclosed in this patent are useful in shaping the response of a throat microphone, they must be used in stages to obtain a sharply rising or falling response characteristic.

SUMMARY OF THE INVENTION

One of the objects of my invention is to provide a throat microphone that discriminates against noise in favor of intelligible voice frequencies.

Another object of my invention is to provide a throat microphone that is sensitive yet compact.

Another object of my invention is to provide a throat microphone that effectively utilizes an electret transducer element.

Other and further objects will be apparent from the following description.

In general, my invention contemplates a contact microphone in which an outer resonant diaphragm adapted to be secured against the throat or other vibrating body portion of a wearer cooperates with a housing to form an outer chamber. A transducer element disposed inside the outer chamber is acoustically coupled to the outer diaphragm. Preferably, the transducer element comprises an electret microphone element having an electret housing forming an inner chamber with the electret diaphragm. The electret diaphragm is preferably perforated to provide pressure relief between the two chambers to give the electret microphone element a rising response characteristic, which is preferably enhanced by a differentiating network in the input circuit of a local preamplifier. The outer diaphragm is so formed as to have a principal resonance preferably at about 3 kilohertz to provide a further emphasis to voice frequencies at or near that resonance.

BRIEF DESCRIPTION OF THE DRAWINGS

In the accompanying drawings, which form part of the instant specification and which are to be read in conjunction therewith, and in which like reference numerals are used to indicate like parts in the various views:

FIG. 3 is an exploded view of the microphone and band assembly shown in FIG. 1.

FIG. 6 is a section of the electret microphone element of the microphone shown in FIG. 4 along line 5—5 thereof, drawn on an enlarged scale.

FIG. 7 is a section of the electret microphone element of the microphone shown in FIG. 6 along line 7—7 thereof, with parts broken away.

DESCRIPTION OF THE PREFERRED EMBODIMENT

Figure 1:
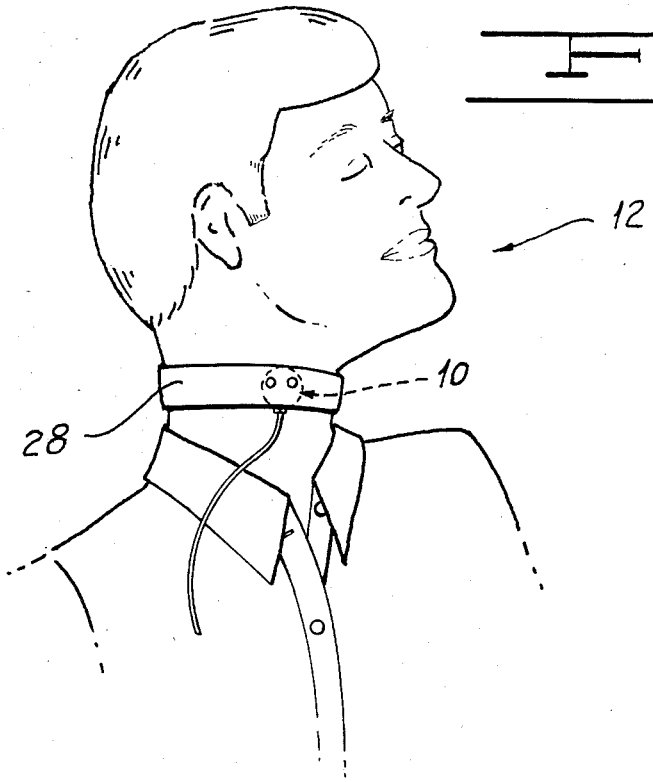
FIG. 1 is a fragmentary elevation of a person wearing my improved microphone and band assembly.
Figure 2:
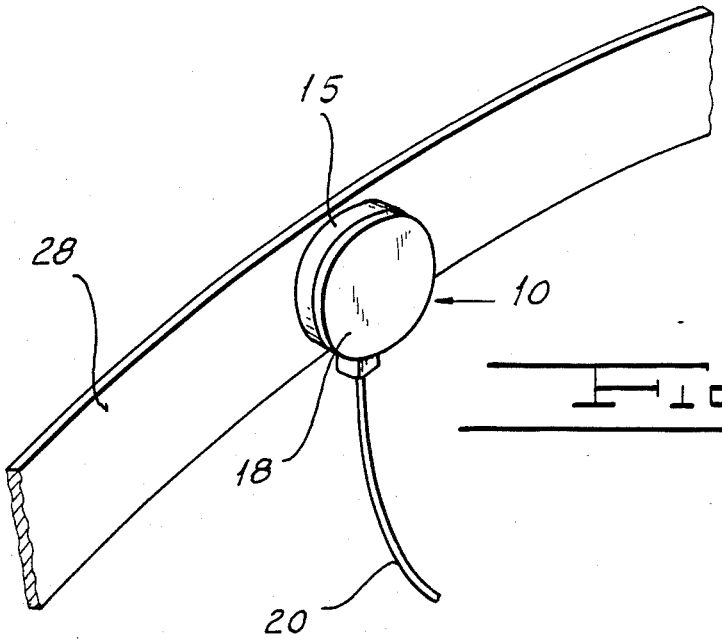
FIG. 2 is a fragmentary elevation of the microphone and band assembly shown in FIG. 1, viewed from the side contacting the wearer.
Figure 1:
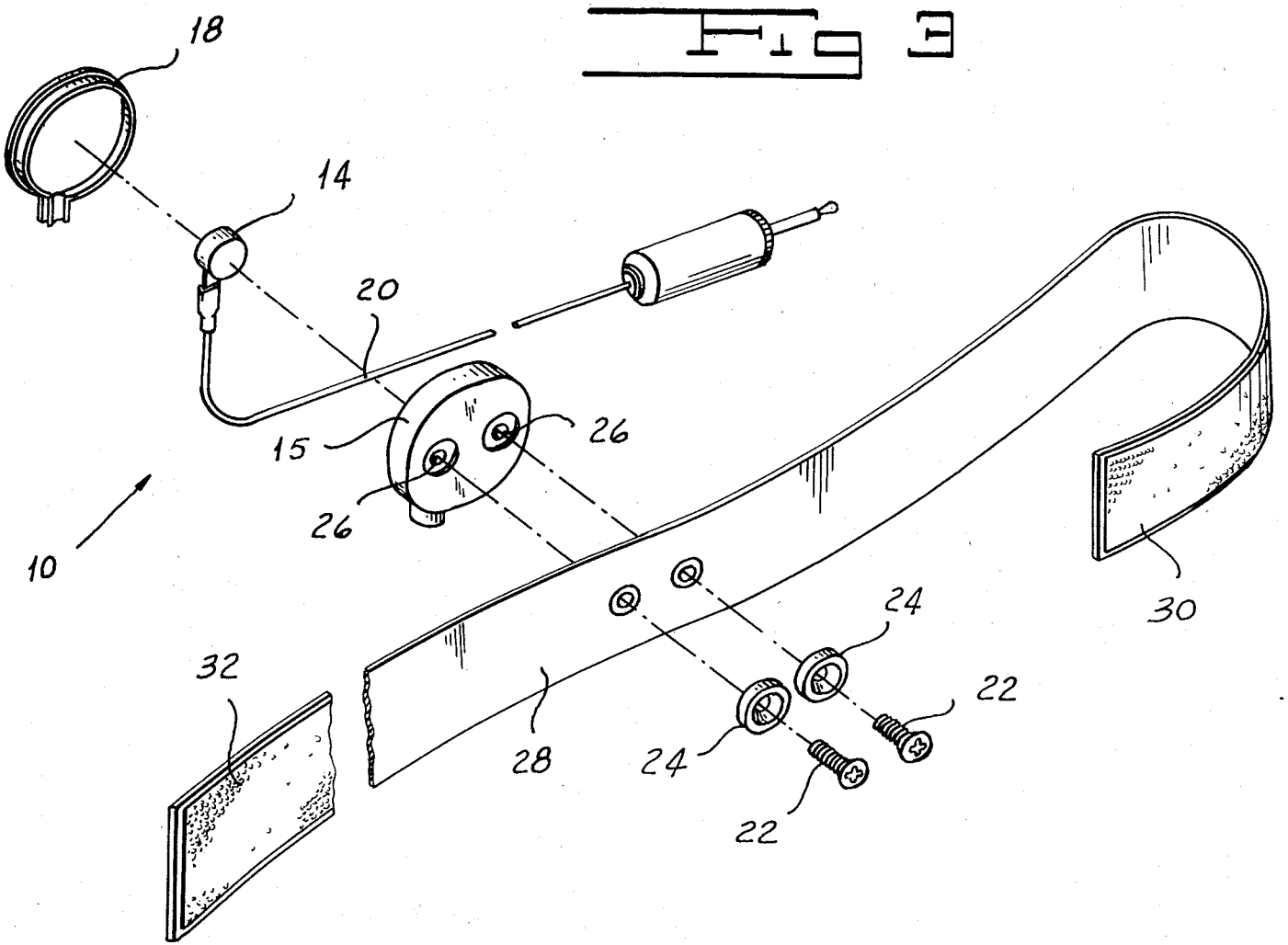
Figure 4:
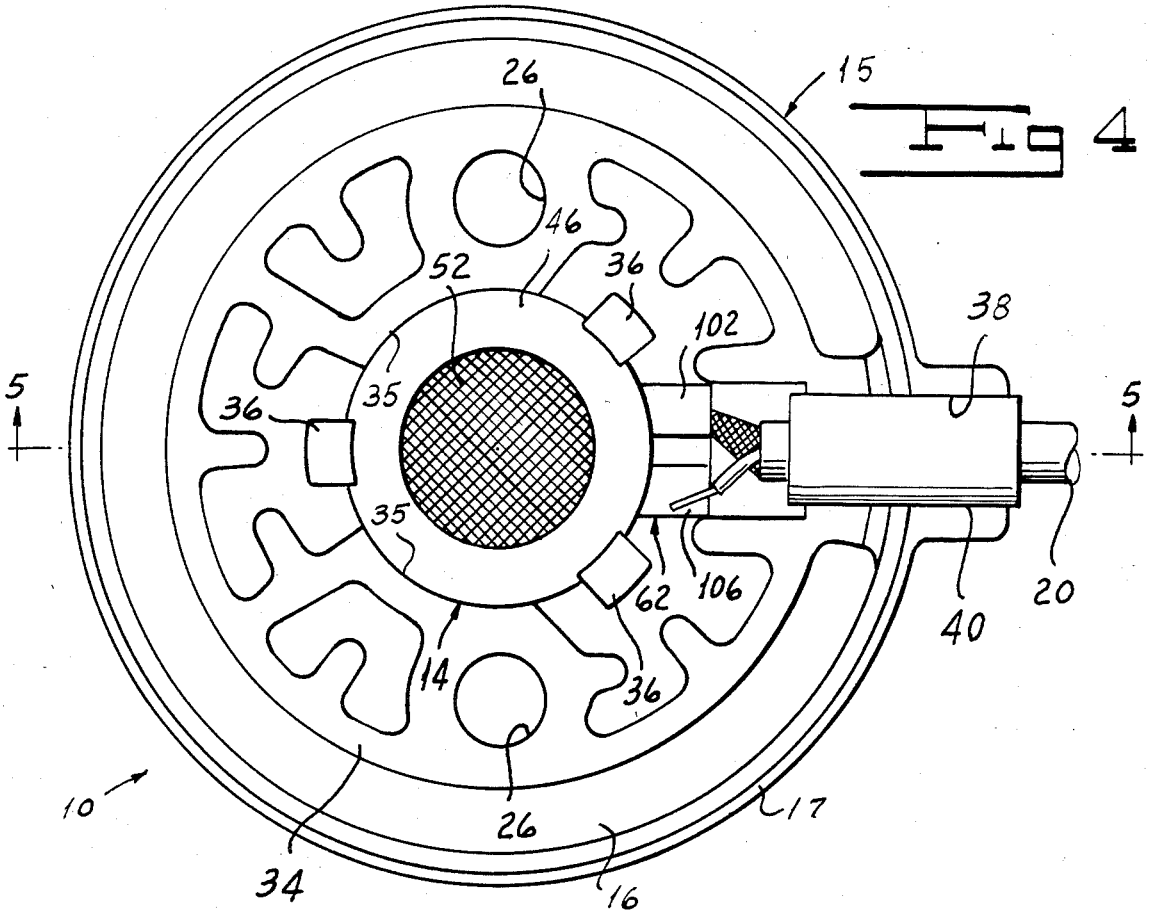
FIG. 4 is a top plan of the microphone shown in FIG. 1, with the outer diaphragm removed.
Figure 5:
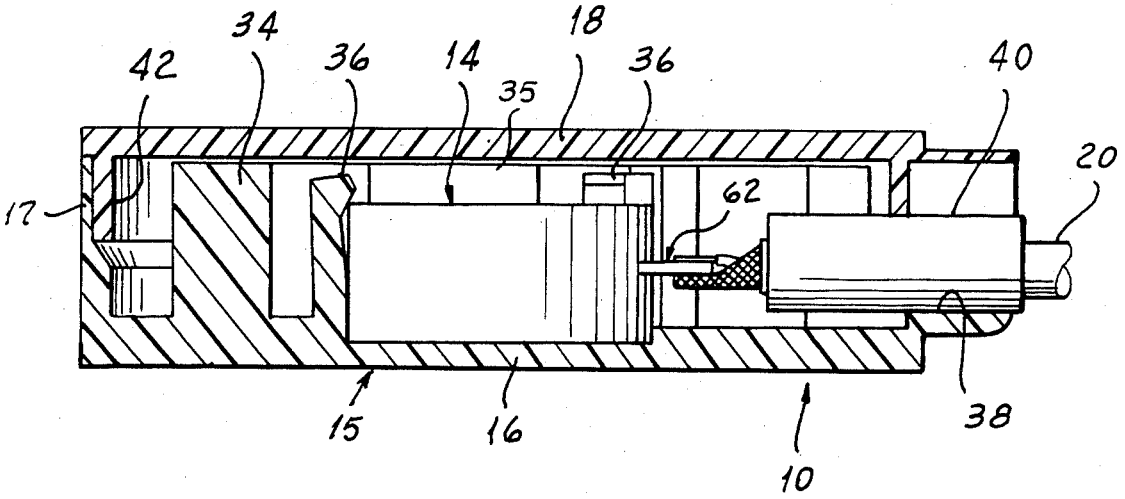
FIG. 5 is a section of the microphone shown in FIG. 4 along line 5—5 thereof.

Referring now to FIGS. 1 to 3, my throat microphone, indicated generally by the reference numeral 10, is intended for use in contact with the throat of a wearer 12 as shown in FIG. 1. Referring also to FIGS. 4 and 5, the microphone assembly 10 includes a generally hollow cylindrical bottom 15 having a base 16 and a peripheral wall 17. Preferably I mold the bottom 15 from a suitable synthetic resin to provide the base 16 with raised portions forming an annular flange 34, a pair of electret microphone positioning bosses 35, mounting screw receiving holes 26, and electret microphone retaining fingers 36. A cover 18, which functions as an acoustic diaphragm in a manner to be described, is formed with a peripheral flange 42 adapted to be received within wall 17 with an interference fit.

The microphone 10 also includes an electret microphone element indicated generally by the reference numeral 14, to be described in further detail below, which is received in the housing defined by bottom 15 and diaphragm 18. A two-conductor coaxial signal lead 20 couples the electret microphone element 14 to an external circuit such as the one shown in FIG. 8, to be described. A radially extending channel 38 formed at a location along the wall 17 of bottom 15 receives a sealing tube 40 carried by the adjacent end of signal lead 20.

Respective screws 22 received in holes 26 formed in the base 16 secure the base to a soft elastic band 28. Preferably, screws 22 carry respective countersunk washers or collars 24 between their heads and the band 28 to distribute the compressive load over a broader surface area of the band. The band 28 is secured around the neck of the wearer 12, with the diaphragm 18 facing inwardly and contacting the wearer's throat, by means of complementary hook-and-loop-type fastener strips 30 and 32 secured to the respective ends of the band 28.

The outer diaphragm 18, which is 23 millimeters in diameter and 0.8 millimeter thick in the embodiment shown, is of such a density and elasticity that it has a principal resonance in the range of voice frequencies, preferably at about 3 kilohertz. Flange 42 is spaced somewhat inwardly radially from the periphery of diaphragm 18 so that the peripheral undersurface of the diaphragm 18 cooperates with the wall 17 of bottom 15 to locate the two members axially relative to each other. Preferably, diaphragm 18 has a seated position spaced somewhat from the raised portions of base 16, as shown in FIG. 5, to permit the diaphragm to resonate freely while contacting the throat of the wearer 12.

Referring now to FIGS. 6 and 7, the electret microphone element 14 is appreciably smaller than the chamber formed by outer diaphragm 18 and bottom 15, being about 8.5 millimeters in diameter and 3.9 millimeters in height. The microphone element 14 includes a conductive base 44 and a conductive cap 46 which fits over the base 44 in intimate contact therewith as shown in FIG. 6 to form a conductive housing. Cap 46 is formed with a counterbored opening providing a port 48 and a recess 50 for receiving a wire screen 52. In the electret element 14 shown, base 44 is formed with a counterbored opening providing a port 54 and a recess 56 for receiving a wire screen 58. Port 54 permits the microphone to function as a velocity microphone when used alone. If desired, the port 54 may be omitted in my microphone assembly A circuit board indicated generally by the reference numeral 60 is sandwiched between base 44 and an annular shoulder 84 formed from the inner surface of cap 46. Circuit board 60 has a rectangular exposed portion or tab 62 which extends out of the housing through a slot 64 formed in the sidewall of cap 46. A nonconductive outer epoxy seal 66 extends along the lower edge of cap 46 and along the interface between tab portion 62 and base 44. Preferably, base 44 is formed with an indentation 68 around its rear periphery to accommodate the epoxy seal 66.

Circuit board 60, which supports the transducer and electronic elements of the microphone element 14, comprises an insulating support 70 having a circular electrode 72 formed on the surface of the circular or enclosed portion of the board 60 remote from base 44. A permanently polarized disk-shaped electret 74 comprising a tetrafluorethylene polymer or the like is bonded to the front surface of the electrode 72. A support ring 76 formed concentrically around electrode 72 on the board 60 supports the periphery of the electret 74. Electret 74 in turn supports an annular polyester spacer 78 to which is bonded a polyester diaphragm 80 having a gold plating (not separately shown) on its front surface. Electrode 72, electret 74, spacer 78 and diaphragm 80 together constitute the transducer element of the microphone element 14. Annular shoulder 84 presses the diaphragm 80 and spacer 78 against support ring 76 and circuit board 60.

In accordance with one aspect of my invention, the diaphragm 80 of the electret microphone element 14 is formed with four 0.005-inch-diameter holes 82, preferably at equally spaced locations equidistant from the center of the diaphragm 80. The holes 82 formed in diaphragm 80 provide a pressure relief between the outer chamber bounded by the outer diaphragm 18 and electret diaphragm 80 and the inner chamber bounded by the electret diaphragm 80 and electret base 44. This pressure relief gives microphone element 14 a rising response characteristic of 6 db per octave in the frequency range of interest, thereby further de-emphasizing spectral components containing large amounts of noise but relatively little intelligible information.

Board 60 is formed with an aperture 86 having a conductive plating on its walls to couple electrode 72 electrically to a plated area 88 on the back surface of the board 60. Electret 74 is also formed with an aperture in registry with aperture 86 to provide an acoustic coupling between the two sides of board 60. Plated area 88 is connected to the gate electrode of a field-effect transistor or FET 90 carried on the rear of board 60. FET 90 has its source electrode coupled to a conductive strip 92 formed on the rear of board 60 and its drain electrode coupled to a conductive strip 94 also formed on the rear of board 60. A gate resistor 96 provides a conductive path between the plated area 88 and an annular peripheral strip 98 formed on the rear of board 60, while a source resistor 100 couples the source strip 92 to the same peripheral strip 98.

A first electrical terminal or contact 102 formed on the rear of tab portion 62 extends inwardly through the slot 64 to join annular strip 98. Similarly, a second electrical terminal 104 formed on the rear of tab portion 62 extends through slot 64 to join the source strip 92. A third terminal 106 formed on the rear of tab portion 62 extends inwardly through slot 64 to join the drain strip 94. A conductive epoxy layer or strip 108 generally coextensive with annular strip 98 couples strip 98 electrically to base 44 and hence cap 46 to allow the strip 98 to serve as a ground or common line. Referring now also to FIG. 4, ground terminal 102 and drain terminal 106 extend around the end of the exposed portion 62 of circuit board 60 to form electrodes on the front surface of board 60 to facilitate attachment to the conductors of signal lead 20. Terminal 102 provides an external connection to the common strip 98, while terminals 104 and 106 provide external connections to the source and drain, respectively, of FET 90. A nonconductive epoxy layer 110 separates the inwardly extending portions of terminals 104 and 106 from the rim of base 44 to preclude the possibility of a short-circuit.

Figure 8:
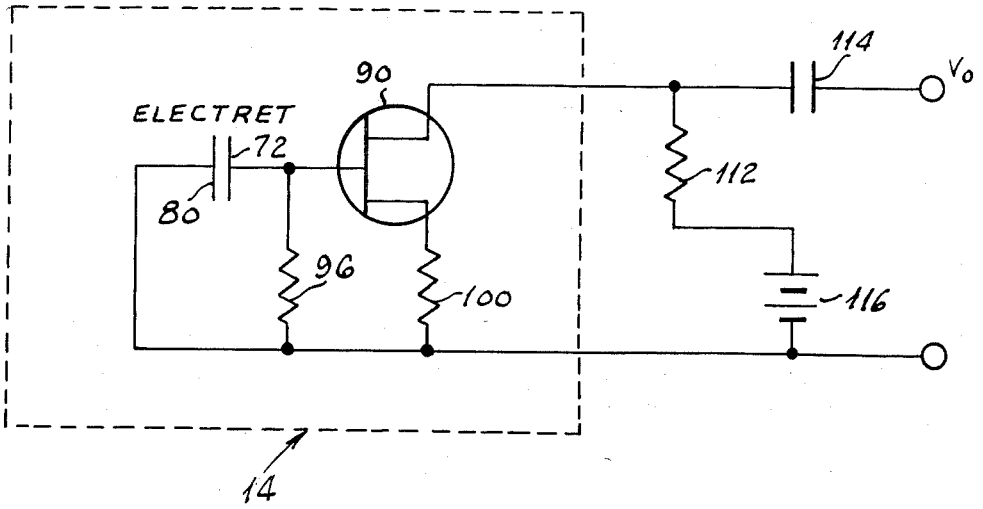
FIG. 8 is a schematic diagram of the preamplifier of the electret microphone element shown in FIG. 6 and of an external circuit to which the preamplifier may be coupled.

Referring now to FIG. 8, a typical external circuit to which terminals 102 and 106 may be coupled via signal lead 20 includes a source 116 of dc potential, preferably between about 3 and 20 volts. A load resistor 112 preferably having a value of about 10 kilohms couples the ungrounded terminal of voltage source 116 to the drain terminal of FET 90. A coupling capacitor 114 preferably having a value of about 0.01 microfarads couples the drain terminal of FET 90 to a line carrying an output signal $V_o$. Preferably the gate resistor 96 associated with FET 90 has a value of approximately 20 megohms, while source resistor 100 has a value of approximately 450 ohms.

Figure 9:
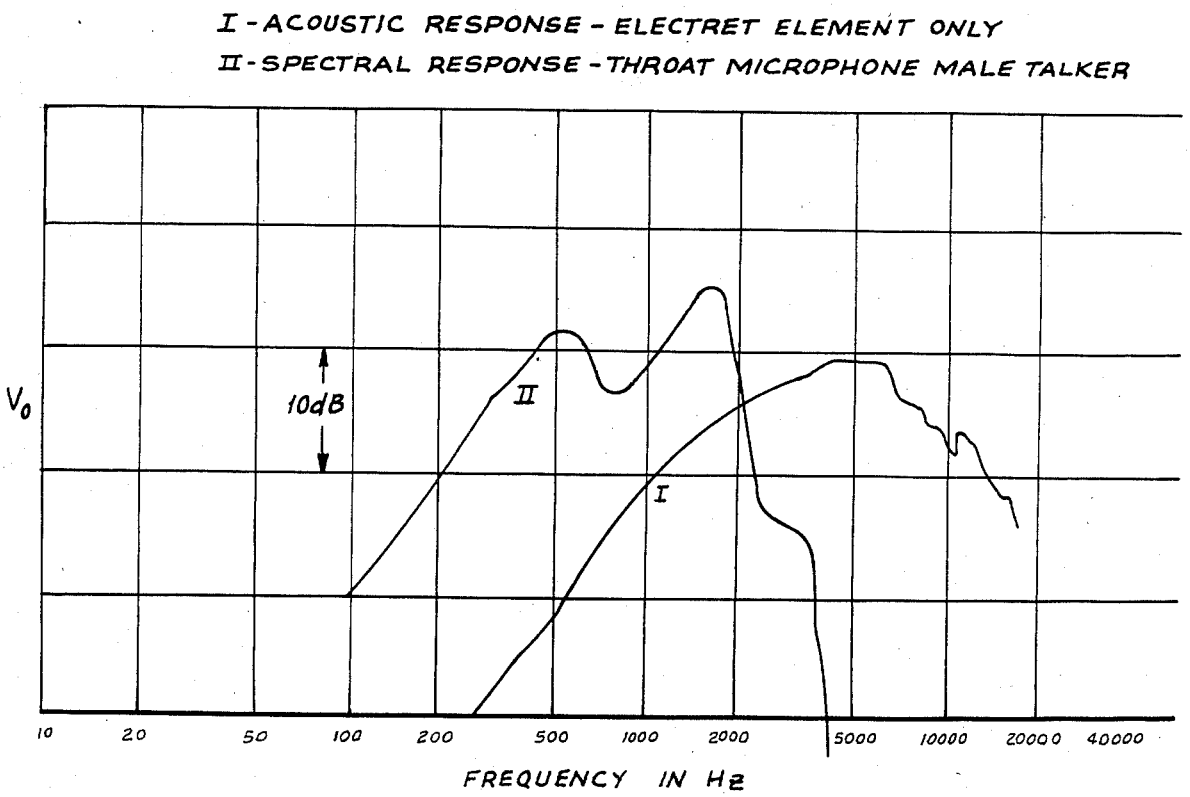
FIG. 9 is a graph of the frequency responses of the microphone shown in FIG. 1 and of the electret element thereof.

Gate resistor 96 cooperates with the capacitor formed by electret elements 72 and 80 to function as a differentiator in the frequency band of interest, imparting an additional 6 db per octave rising response characteristic to the overall frequency response. FIG. 9 shows the frequency response (I) of the electret microphone element 14 alone, as well as the overall response (II) of the throat microphone 10 on a male wearer. It will be noted first that the response (I) of the electret microphone element 14 itself has a rising characteristic up to about 5 kHz, owing to the combined effects of the pressure relief afforded by holes 82 in diaphragm 80 and the differentiating action of the gate circuit of FET 90. The overall response (II) of the throat microphone 10, which is further shaped by the mechanical resonance of the outer diaphragm 18 at approximately 3 kHz, is flat to within ±5 db between about 500 Hz and about 2 kHz, rolls off at about 10 db per octave at frequencies below 500 Hz and rolls off sharply at frequencies above the principal resonance of the outer diaphragm 18.

Except for the holes 82 formed in diaphragm 80 and the relatively short time constant of the FET gate circuit, electret microphone element 14 is generally similar to the one disclosed in the copending application of Paul L. Cote, Ser. No. 209,519, filed Nov. 24, 1980, now U.S. Pat. No. 4,443,666, entitled "Electret Microphone Assembly," as well as in the corresponding British application, Specification No. 2 089 170 A, published on June 16, 1982.

It will be seen that I have accomplished the objects of my invention. My throat microphone discriminates against noise in favor of intelligible voice frequencies, and effectively realizes the sensitivity and compactness obtainable by using an electret transducer element.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A contact microphone including in combination an outer diaphragm adapted to contact a vibrating body portion, said diaphragm having a resonance at about 3 kilohertz, an electret transducer element having an electret diaphragm, means cooperating with said outer diaphragm and said electret diaphragm to form a first chamber on one side of said electret diaphragm, said chamber acoustically coupling said outer diaphragm to said electret diaphragm, and means cooperating with said electret diaphragm to form a second chamber on the other side of said electret diaphragm from said first chamber, said electret diaphragm being perforated to provide pressure relief between said first and second chambers, said pressure relief being such as to give said transducer element a rising response characteristic over a frequency range extending up to said resonance.

2. A microphone as in claim 1 in which said electret diaphragm comprises a first electrode, said transducer element including a second electrode cooperating with said first electrode to form a capacitor, and a resistor coupled between said electrodes, said resistor and said capacitor having such a time constant as to enhance said rising response characteristic over said range.

3. A contact microphone including in combination an outer diaphragm adapted to contact a vibrating body portion, said diaphragm having a resonance at about 3 kilohertz, a transducer element having a transducer diaphragm, means cooperating with said outer diaphragm and said transducer diaphragm to form a first chamber on one side of said transducer diaphragm, said chamber acoustically coupling said outer diaphragm to said transducer diaphragm, and means cooperating with said transducer diaphragm to form a second chamber on the other side of said transducer diaphragm from said first chamber, and said transducer diaphragm being perforated to provide pressure relief between said first and second chambers, said pressure relief being such as to give said transducer element a rising response characteristic over a frequency range extending up to said resonance.

4. An electret transducer element including in combination a diaphragm comprising a first electrode, means cooperating with said diaphragm to form a chamber on one side thereof, said diaphragm being perforated to provide pressure relief between said chamber and the other side of said diaphragm, said pressure relief being such as to give said transducer element a rising response characteristic over a frequency range extending up to about 5 kilohertz, a second electrode cooperating with said first electrode to form a capacitor, and a resistor coupled between said electrodes, said resistor and said capacitor having such a time constant as to enhance said rising response characteristic over said range.

* * * * *